US010874181B2

(12) United States Patent
Torresan

(10) Patent No.: US 10,874,181 B2
(45) Date of Patent: Dec. 29, 2020

(54) PROCESS FOR MAKING A JEWELRY ARTICLE, IN PARTICULAR A BRACELET

(71) Applicant: NUOVI GIOIELLI S.R.L., Mussolente (IT)

(72) Inventor: Ivano Torresan, Mussolente (IT)

(73) Assignee: NUOVI GIOIELLI S.R.L., Mussolente (IT)

( * ) Notice: Subject to any disclaimer, the term of this patent is extended or adjusted under 35 U.S.C. 154(b) by 129 days.

(21) Appl. No.: 16/081,956

(22) PCT Filed: Feb. 2, 2017

(86) PCT No.: PCT/IB2017/050570

§ 371 (c)(1),
(2) Date: Sep. 4, 2018

(87) PCT Pub. No.: WO2017/158445

PCT Pub. Date: Sep. 21, 2017

(65) Prior Publication Data

US 2019/0059530 A1 Feb. 28, 2019

(30) Foreign Application Priority Data

Mar. 18, 2016 (IT) ..... 102016000028867

(51) Int. Cl.

| | |
|---|---|
| ***A44C 27/00*** | (2006.01) |
| ***A44C 5/00*** | (2006.01) |
| ***A44C 15/00*** | (2006.01) |

(52) U.S. Cl.

CPC ..... *A44C 27/00* (2013.01); *A44C 5/0092* (2013.01); *A44C 15/005* (2013.01); *Y10T 29/49591* (2015.01)

(58) Field of Classification Search

CPC ..... A44C 27/00; A44C 5/0092; A44C 15/005; B65H 81/06; B65H 81/08; B29C 53/58; B29C 53/562; B29C 53/62; B29C 53/64; B29C 53/66; B29C 53/70; Y10T 29/49588–49597

See application file for complete search history.

(56) References Cited

U.S. PATENT DOCUMENTS 7,444,801 B2 * 11/2008 Rosenwasser ..... A44C 11/00 59/35.1
2003/0074918 A1 * 4/2003 Disegna ..... A44C 27/006 63/4

(Continued)

FOREIGN PATENT DOCUMENTS

DE 10027118 12/2001
EP 0638256 2/1995

(Continued)

*Primary Examiner* — Sarang Afzali
(74) *Attorney, Agent, or Firm* — Mark M. Friedman

(57) ABSTRACT

A process for making a jewelry article, which envisages to carry out several ornamental wires, each made of an internal core covered with an external strip in a precious material. The ornamental wires are then wound around the elongated support to form a cord of ornamental wires. Then the elongated support is removed from the cord, and the internal core of each ornamental wire is removed from the corresponding external strip, in order to obtain a lightened jewelry article.

12 Claims, 3 Drawing Sheets

(56) References Cited

U.S. PATENT DOCUMENTS

| | | | | |
|---|---|---|---|---|
| 2006/0042222 | A1* | 3/2006 | Rancan | A44C 5/025 59/80 |
| 2009/0094959 | A1* | 4/2009 | Cerato | B21F 19/00 59/1 |
| 2010/0242541 | A1* | 9/2010 | Nezuka | D04D 9/00 63/38 |

FOREIGN PATENT DOCUMENTS

| | | |
|---|---|---|
| EP | 2050350 | 4/2009 |
| GB | 2042943 | 10/1980 |
| IT | 1154682 | 1/1987 |
| IT | 1212497 | 11/1989 |
| WO | 2007148351 | 12/2007 |

* cited by examiner

PROCESS FOR MAKING A JEWELRY ARTICLE, IN PARTICULAR A BRACELET

FIELD OF APPLICATION

The present invention relates to a process for making a jewelry article, in particular a bracelet.

The process involved is intended to be used in the industry for manufacturing jewelry articles, preferably made of precious metal such as gold and silver, or of precious metal alloys, i.e. semi-precious metals. The jewelry articles obtained with the process according to the invention are of the type comprising a cord formed by one or more spiral-wound ornamental wires made of a precious or semi-precious metal, which can be used to make various jewelry products such as e.g. bracelets, necklaces and similar articles, intended for the gold product market. Advantageously, such articles according to the invention have hollow wires made of precious or semi-precious metal to decrease the weight in precious metal such as to be more affordable and lightweight than those traditionally known with solid core wires.

BACKGROUND ART

Over the last few years, the market of jewelry articles with a low content of precious metal—and gold in particular—has greatly expanded, and in many countries may now be compared with that of traditional jewelry articles made of solid gold. The expansion of this new market is essentially associated with the fact that even though these articles are sold at a selling price which is adequate to the smaller gold content included for their manufacturing, they cannot be identified from traditional solid gold articles, if not for their weight. In fact, the processes for making jewelry articles with hollow precious metal wires and the care of the finishing used substantially make articles of the same shape but with a different gold content unidentifiable in terms of appearance.

Many articles have been proposed to meet the needs of this new market, and several processes for making them have been implemented to reduce the amount of precious metal used without ruining the appearance and mechanical features of the articles themselves.

The known processes for making jewelry articles of the type having a "hollow structure" generally include using filiform internal cores such as copper aluminum, iron or plastic cords or wires, which mechanically sustain an outer gold coating during the processing steps. The cores are then eliminated at the end of processing by means of dissolution in acid or caustic baths. However, the use of these known processes to date has not allowed to obtain hollow gold (or other precious or semi-precious metal) articles with particularly thin walls and which are mechanically resistant.

In particular, a known manufacturing process, for example described in Patents EP 638256 and IT 1154682, resulted in the sale of jewelry articles comprising a cylindrical section annular body (substantially torus-shaped) consisting of a thin layer of completely hollow gold alloy.

Such jewelry articles of known type consist of a closed tube welded on the longitudinal opposite edges parallel to the main extension axis of the same torus.

The main drawback of this process is the poor features of mechanical resistance of the jewelry article which it allows to be achieved; indeed, the annular body made of precious metal is not mechanically highly resistant and is susceptible to being deformed, for example due to collapsing, during the processing steps carried out on the tubular body itself.

A further drawback lies in that jewelry articles made by means of such processes of known type have a torus-shaped geometrical structure and therefore a mechanical structure which is difficult to be deformed and has little elasticity.

Within such a scope, a process for making jewelry articles is also known which includes making cords having various forms with which necklaces, bracelets and other ornamental articles are then obtained.

In particular, articles have been introduced onto the market which were obtained from solid wires which are easy to be processed by automated or semi-automated machines for forming the aforesaid cords having various shape and size.

In greater detail, as described for example in Patent EP 2050350, the cords are obtained from a spiral-wound wire formed by an internal core made of non-precious metallic material (generally iron or aluminum) and by a precious metal covering such as gold, silver or the alloys thereof which is clamped onto the core to make an ornamental wire having the required mechanical resistance for sustaining the processing required in the production of the cords.

Once formed, the cords are emptied of the internal core made of non-precious metal by means of baths in solutions of acids such as for example, hydrochloric acid for removing iron cores.

A drawback of the jewelry articles thus made is the low elasticity, since the cords they consist of are mechanically fragile and subject to plastic deformations, also in the regular use thereof.

A further drawback of the processes for making jewelry articles comprising cords and of the known type described above is that they do not allow large products provided with cords with particular shapes (e.g. a flattened form) to be obtained due to the difficulties encountered in shaping the solid core wires of the cords.

A further process for making jewelry articles is known, which includes using the metallurgical technique of lost wax casting, in particular a microcasting process, which consists in preparing a wax model having the same form as the jewelry item to be made. A layer of thermosetting resin and ceramic granules is set around the model, which together form a mold outside the highly resistant wax. The wax is then melted and removed from the mold, for example by means of heating in a furnace. Finally, the precious metal forming the jewelry article is poured into the mold, thus forming the jewel which once cooled, is extracted from the mold and is polished. Such a process allows jewelry articles of any form and size to be made.

One drawback of jewelry articles obtained by means of such a process consists of the increased production cost and subsequent increased selling price, since the jewelry item consists of a single body made of precious metal.

A further drawback of the jewelry articles obtained by means of such a process is that they are not elastic, but rather they are highly resistant to any type of mechanical stress. Such a property is not appropriate for a jewel, the purpose of which is to be used daily.

A further process for making jewelry articles is known, which includes winding an ornamental chain around an elongated support, thus forming an article having a cord with tight spirals.

In particular, a known manufacturing process, for example described in Patent IT 121249, includes winding a flexible ornamental wire made of precious metallic material onto an elongated support which may be hollow for lightness. In particular, such a process includes winding the ornamental wire with tight spirals and then welding the chain onto the elongated support.

The main drawback of the jewelry articles which may be made by means of such a known process is that it is not at all flexible and may be not be easily deformed.

A further drawback of the manufacturing process of known type described above is that it requires a preceding preparation of a chain made of precious metal, which is not highly flexible and does not allow to wind a second ornamental chain around the same elongated support.

Presentation of the Invention

Therefore, in this circumstance, it is the main object of the present invention to eliminate the drawbacks of the above-mentioned known art by providing a process for making a jewelry article and a jewelry article obtained by means of such a process, which include using a lightweight and elastically deformable cord with spiral-wound ornamental wires.

It is a further object of the present invention to provide a process for making a jewelry article and a jewelry article obtained by means of such a process, which includes a cord with spiral-wound ornamental wires, which cord may be shaped into different forms without compromising the appearance and mechanical features thereof.

It is a further object of the present invention to provide a process for making a jewelry article, which article is externally made of precious metal and is affordable.

It is a further object of the present invention to provide a process for making jewelry articles which are affordable, versatile and easy to be made.

It is a further object of the present invention to provide a jewelry article which is affordable, mechanically resistant and lightweight.

BRIEF DESCRIPTION OF THE DRAWINGS

The technical features of the invention according to the aforesaid objects are clearly noticeable from the content of the claims below, and the advantages thereof will become more apparent from the detailed description below, made with reference to the accompanying drawings, which depict one embodiment thereof given purely by way of non-limiting example, in which:

DETAILED DESCRIPTION

Figure 1:
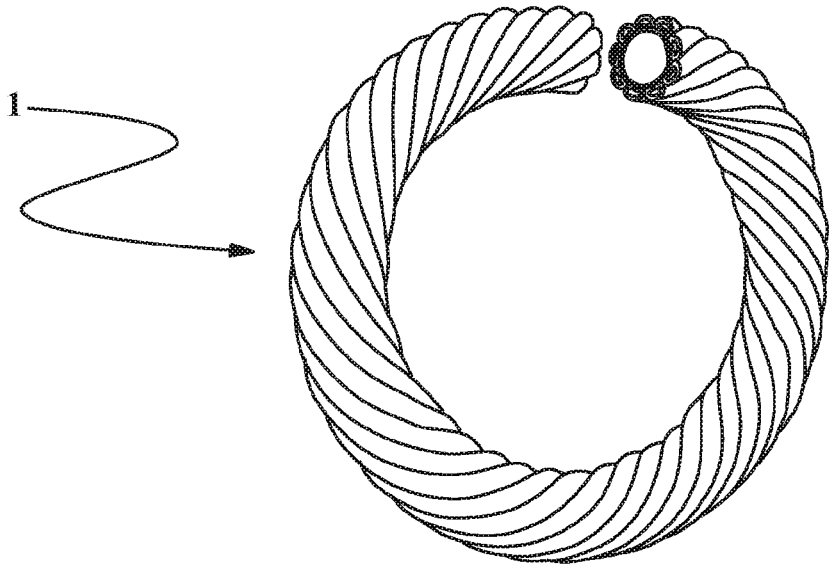
FIG. 1 is a perspective view of a jewelry article comprising a cord obtained with the method according to the invention, in a second embodiment thereof.

With reference to the accompanying figures, a jewelry article according to the present invention is indicated as a whole with numeral 1, which is advantageously obtainable by means of the process of the present invention.

The following description of the manufacturing process of the present invention is made below with reference to a jewelry article consisting of a bracelet, this however meaning that the same article may consist of a necklace or another precious or semi-precious jewel without departing from the scope of protection of the present invention.

The process for making the jewelry article according to the present invention first comprises a step of arranging an elongated support 6, which is stretched between two ends thereof along a longitudinal extension direction Y.

As specified later, the elongated support is retained at the ends by the rotating heads of a winding machine.

The process then includes a step of making at least one ornamental wire 5, which step is obtained by covering at least one internal core 3 made of a first metallic material with at least one external strip 4 made of a first precious or semi-precious metallic material.

The first metallic material of the internal core 3 is preferably selected from a non-precious metal, such as e.g. aluminum, iron or copper, or a non-precious metal alloy.

The first precious material for the external strip 4 of the ornamental wire 5 preferably consists of a precious metal, e.g. gold, silver or platinum, or of a precious metallic material alloy.

The elongated support 6 is preferably selected as the first non-precious metallic material, from a second metallic material, also preferably non-precious, e.g. aluminum, iron or copper, or a non-precious metal alloy.

The aforesaid first and second non-precious metallic materials may be the same or different according to the embodiment specified later.

Advantageously, the external strip 4 has a flattened form and is provided with longitudinal edges 4', which are substantially parallel to one another.

Preferably, the external strip 4 made of precious or semi-precious material has a width ranging between 2 mm and 10 mm.

The aforesaid step of making an ornamental wire 5 may be obtained by forming, i.e. by means of a plastic deformation of the external strip 4, which causes the latter to wind the internal core 3, thus placing the longitudinal edges 4' side-by-side while keeping the longitudinal extension of the external strip 4 parallel to the longitudinal extension of the internal core 3.

Advantageously, the forming for example occurs by means of using a forming head 2, in particular a drawing machine type head, which is fed simultaneously with the internal core 3 and with the external strip 4, which are coupled and moved close to each other. In greater detail, a shaped hole is provided in the drawing head 2, which hole closes the external strip 4 on the internal core 3 up to placing the longitudinal edges 4' side-by-side and aligned with respect to the longitudinal extension of the internal core.

Figure 2:
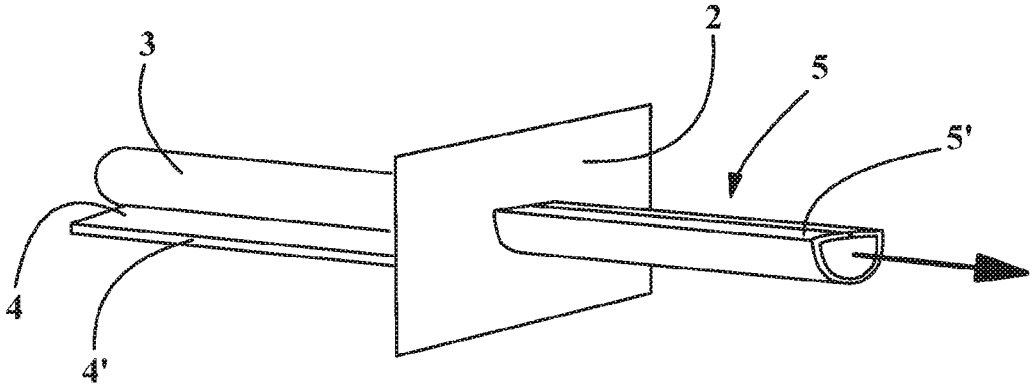
FIG. 2 shows a step of the process for making a jewelry article according to the invention, related to a drawing step.

Preferably, the ornamental wire 5 comes out of the hole of the drawing head 2 with a flat face 5', which extends along the entire longitudinal extension thereof, according to that depicted diagrammatically in FIG. 2.

Such a flat face 5' of the ornamental wire 5 may be generated by deforming the external strip 4 on a corresponding flattened surface of the internal core 3, which was already provided when the drawing head was fed in a preceding forming step, or it may be directly generated as a result of the plastic deformation through the hole of the drawing machine.

The process according to the invention further comprises a step of spiral-winding at least one ornamental wire 5 obtained as indicated above, around the elongated support 6 along the longitudinal extension direction Y, in order to obtain a solid cord 15.

Such a solid cord 15 has a pleasant appearance which may be used to make different types of pieces of jewelry.

With times and methods which may vary according to the specific embodiment, the process includes a first step of removing the elongated support 6 from the solid cord 15 and a second step of removing the internal core 3 from the ornamental wire 5 of the solid cord 15.

According to the idea at the basis of the present invention, the aforesaid manufacturing step includes covering the internal core 3 with the external strip 4 up to placing the longitudinal edges 4' side-by-side in a mutually opposite position, with the edges themselves separated by a slit 4", also longitudinal, which is positioned at the flat face 5' of the ornamental wire 5.

Again according to the invention, the step of spiral-winding the ornamental wire 5 around the elongated support 6 is performed by keeping the flat face 5' of the ornamental wire 5 always facing the elongated support 6, so as to hide it from sight once the cord is formed.

Figure 3:
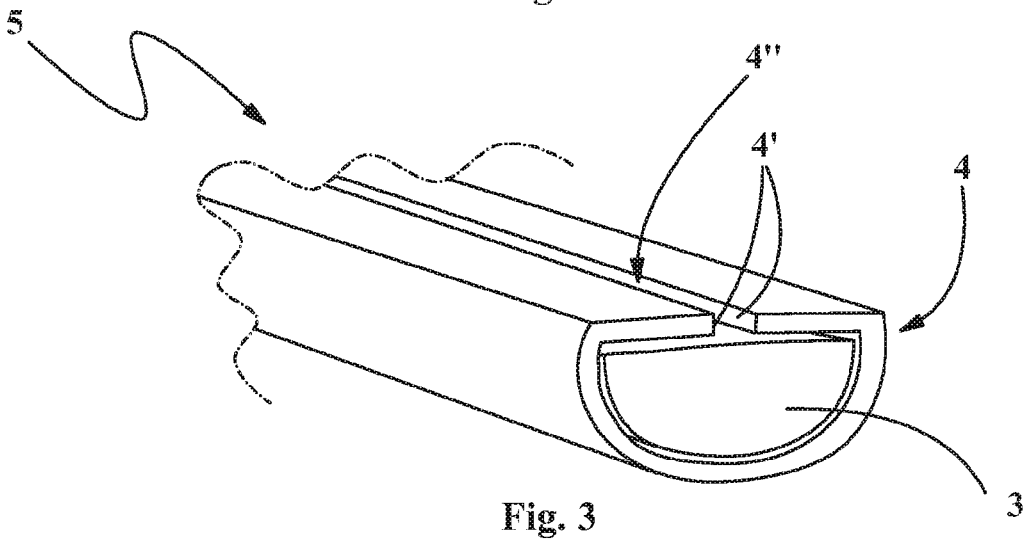
FIG. 3 is a perspective view of an ornamental wire obtained by means of a step of performing the process according to the invention.

Preferably, the ornamental wire 5 is also provided with a convex face, opposite to the flat face 5', which joins the two side margins of the flat face 5', as shown for example in FIG. 3. As specified later, while the flat face 5' is not visible in the finished article (and therefore the presence of the unappealing slit 4" not being important) the convex face is intended to remain visible and therefore advantageously continues without any gaps.

Figure 4:
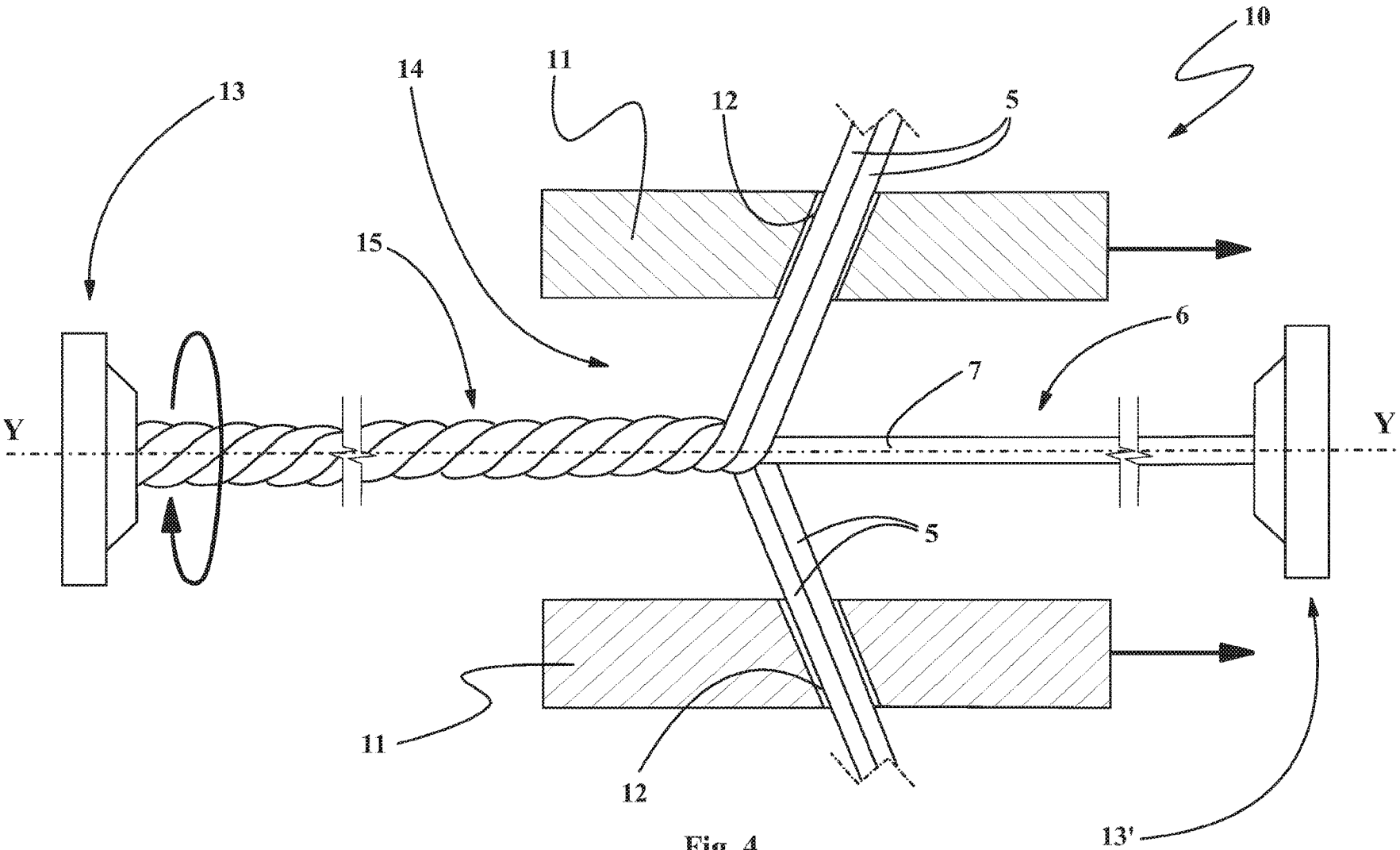
FIG. 4 shows a step of the process for making a jewelry article according to the invention, related to a winding step.

According to a first embodiment shown in FIG. 4, the ornamental wire 5 is wound around the elongated support 6, which consists of one support wire 7 alone.

Figure 5:
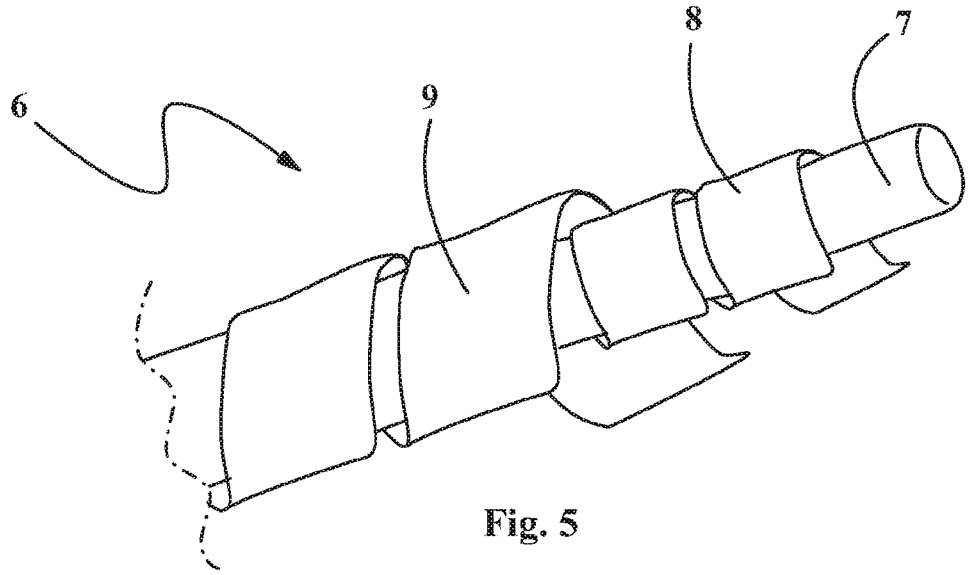
FIG. 5 shows a step of the process for making a jewelry article according to the invention, related to a step of arranging an elongated support, in a second embodiment thereof.

According to a second embodiment shown in FIG. 5, the elongated support 6 is obtained with several components. In greater detail, the step of arranging the elongated support 6 here includes spiral-winding a first elongated plate 8 consisting of a third metallic material onto the support wire 7, which in turn consists of the second metallic material. Preferably, the third metallic material selected for the first elongated plate 8 is a non-precious metallic material, e.g. aluminum, iron or copper, or a non-precious metal alloy. Moreover, the second and third metallic materials may be the same to facilitate a first step of removing the elongated support 6, which will be described later.

According to such a second embodiment, there is further included a step of spiral-winding a second elongated plate 9 made of a metallic material, preferably a second precious or semi-precious material, around the spiral of the first elongated plate 8.

The second precious metallic material is e.g. gold, silver or platinum, or a precious metallic material alloy.

Advantageously, the second elongated plate 9 made of the second precious material is susceptible to remaining in the jewelry article obtained by means of the process of the present invention in order to confer elasticity and mechanical resistance to plastic deformations both during the successive operating steps included by the process and during the normal use by the final user.

In a third embodiment not depicted in the accompanying figures, the aforesaid step of arranging the elongated support 6 includes using a support wire 7 with a flattened form made of the second metallic material, on which the first elongated plate 8 and the second elongated plate 9 are then wound adhering one on top of the other.

In particular, according to such a third embodiment, such a support wire 7 is formed by a widened plate preferably having rounded edges.

The number of ornamental wires 5 to be wound onto the elongated support 6 to make the cord may vary according to both reasons of appearance and according to the diameter of the cord to be obtained.

FIG. 4 depicts, by way of example, the winding of four ornamental wires 5 around the elongated support 6, which is stretched at the two ends thereof. In the second and third embodiments disclosed above, the ornamental wires 5 are thus wound around the second metallic elongated plate 9.

The winding of the ornamental wire(s) is preferably obtained by means of a winding machine (mentioned above), which comprises two motorized rotating heads 13, 13', each equipped with a mandrel for holding the elongated support 6 at a respective end, so as to put it in tension between its own ends.

Moreover, a first head 13 of the two rotating heads 13, 13' also has one end of the ornamental wire 5 (or the ends of several ornamental wires 5) fixed thereto which it rotates in conjunction with the elongated support 6.

Furthermore, the step of spiral-winding the ornamental wires 5 around the elongated support 6, and therefore for example around the second elongated plate 9 of the elongated support 6 according to the second and third embodiments, requires advancing a trolley 10 along the longitudinal direction Y of the elongated support 6, from the first rotating head 13 to the second rotating head 13'.

Trolley 10 advantageously comprises at least one, and preferably two, guide bodies 11, which are mechanically mounted on trolley 10 to follow it in the advancing motion thereof. Each guide body 11 has at least one through seat 12, obtained transverse to the longitudinal direction Y of the elongated support 6 and adapted to guide the ornamental wires 5 during the winding step, as depicted in FIG. 4.

According to this last FIG. 4, two ornamental wires 5 are provided, which feed the through seats 12 of the guide bodies 11. Such guide bodies 11 are mounted on trolley 10 on opposite sides with respect to the elongated support 6, and delimit a middle opening 14 crossed by the elongated support 6 itself, at which the winding of the ornamental wires 5 occurs around the same elongated support 6. Thereby, the cutting efforts by which the elongated support 6 is stressed during the winding are balanced with respect to the longitudinal axis Y, thus minimizing the stresses and ensuring an optimal result.

Operatively, the winding step includes rotating both the heads 13, 13' and advancing trolley 10; thereby, each ornamental wire 5 feeds a corresponding through seat 12 of each guide body 11, thus causing the wire itself to spiral-wind onto the rotating elongated support 6.

Trolley 10 preferably moves at constant speed in the longitudinal extension direction Y.

In particular, the through seat 12 of each guide body 11 has a flat face on which the flat face 5' of one or more corresponding ornamental wires 5 slides for an improved guiding of the ornamental wires 5 without the possibility of a rotation thereof in the same through seat and therefore altogether without the risk of twisting or intertwining between the wires.

Advantageously, each through seat 12 of each guide body 11 of trolley 10 tangentially feeds the elongated support 6 during the winding so as to minimize the stresses on the ornamental wires 5 with respect to stresses lying on the plane orthogonal to the longitudinal direction Y.

In greater detail, such through seats 12 tangentially feed the elongated support 6 in diametrically opposite positions.

Operatively, there is a need to adjust the position of the through seats 12 with respect to the elongated support 6 itself to keep the feeding of the wires tangential to the elongated support 6.

For this purpose, the guide bodies 11 are susceptible to being moved in an adjustable manner on two orthogonal axes, in particular in height and depth, with respect to the position of the elongated support 6 so as to position the through seats 12 always tangentially with respect to the external profile of the same elongated support 6. Thereby, the ornamental wires 5 feed by exerting balanced stresses on the elongated support 6 and spiral-wind around it without being deformed, thus allowing an optimal winding and an optimal appearance of the final product.

The winding may be for example controlled by an operator by means of an electronic control unit comprising an input interface, a touch screen and/or an electronic calculator, which are adapted to receive the value setting of the advancing speed of trolley 10 and of the rotation angle speed of the rotating heads 13, 13' from the operator. In order to achieve the winding of the ornamental wires 5 on the elongated support 6 with the individual adjacent spirals in contact with one another, such two speed parameters are mutually bound, along with the diameter of the elongated support 6, to the number of ornamental wires 5 to be braided and to the dimension thereof. By entering the proper set of parameters which are easy to be calculated by those skilled in the art based on the information above, the winding occurs with each spiral of the ornamental wires 5 adherent to the preceding ones, thus using all the spaces and without subjecting neither the ornamental wires 5 nor the elongated support 6 to plastic deformations.

A solid cord 15 is thus obtained by means of such an operating winding step, comprising at least one spiral-wound ornamental wire 5 and the elongated support 6 arranged inside the winding of the same ornamental wire 5. The solid cord 15 is then released from the rotating heads 13, 13' to be subjected to the successive operating steps.

The solid cord 15 obtainable in the third embodiment, which includes using a support wire 7 with a flattened form, is substantially oval, elliptical or more generally leveled in shape. Such a shape will be indicated below as elliptical, such an indication however meaning that it may refer more broadly to a generally leveled or oval shape.

Such an elliptical-shaped solid cord 15 ideally has the outer surface which can ideally be divided into four opposite two-by-two strips, in particular two have a large radius of curvature and two have a small radius of curvature. The strips with small radius of curvature are narrower than those with large radius of curvature.

Thus, after the winding step, the cord obtained with such a third embodiment has the spirals of the ornamental wires 5 very adherent to one another at the strips with small radius of curvature, while it has spirals which are contiguous with a gap interposed therebetween at the strips with large radius of curvature.

Such a gap increases in size upon an annular shaping step described below and is completely eliminated according to an advantageous step of the process according to the invention, which will also be described in detail below.

The process according to the invention further comprises an annular shaping step, in which the solid cord 15 is wound and leveled around a tubular body, which may be solid or hollow and preferably has a rounded external profile, for example a plate with beveled edges. In such an annular shaping step, the solid cord 15 is plastically deformed by means of the application of an external force, for example applied by means of automated machines.

The shaping step should occur after the separate winding step which should deform the cord, as explained above. However, according to the second and third embodiments, the annular shaping step is preferably carried out immediately after the aforesaid winding step and before a first step of removing the elongated support 6 from the solid cord 15, while according to the first embodiment, the annular shaping step is preferably carried out following the first step of removing the elongated support 6 from the solid cord 15, as is more clearly explained below.

The first elongated plate 8 serves the purpose of avoiding the solid cord 15 from collapsing during the annular shaping step, thus forming folds and deformations which compromise the appearance thereof, i.e. thus substantially reducing the section thereof which should indeed remain substantially constant during such a forming. At the same time, the elongated plate 8 should allow an easy deformation of the cord during the aforesaid shaping step, without imposing excessive resistance.

Surprisingly, it has been observed how the elliptical form of such an elongated plate 8 succeeds in better responding to the aforesaid needs, thus allowing the folds of the cord to be avoided during the aforesaid annular shaping step by opposing a modest resistance to the external forces required for shaping the cord on the tubular body.

Thereby, the annular shaping step allows the solid cord 15 to be plastically deformed without requiring the application of increased forces which could damage or ruin it.

According to the third embodiment, as anticipated above, following the annular shaping step, the gaps interposed between adjacent spirals, which were already present following the winding step, in particular at the strips with large radius of curvature, may be accentuated, thus increasing the width and therefore affecting the appearance of the jewelry article. Advantageously, there is included a molding via pressing step to obviate such a drawback, which is described later.

The process for making a jewelry article according to the invention then includes a first step of removing the elongated support 6 from the solid cord 15.

According to the first embodiment, the elongated support 6 comprises only the support wire 7 made of the second metallic material, which is subject to the first removal step by means of axial extraction. During such an axial extraction step, the support wire 7 slides axially along the longitudinal direction Y with respect to the spirals of the ornamental wires 5 which are wound about it. Operatively, such an operation may be actuated by an operator by means of the assistance of gripping means, such as e.g. small pincers.

Otherwise, such a first removal step may be obtained by means of dissolving the support wire 7 in a bath of chemical agents in which the solid cord 15 is inserted.

The chemical agents for the dissolution are selected between agents adapted to selectively dissolve the second metallic material of the support wire 7 without affecting or damaging the first precious metal of which the external strip 4 of each ornamental wire 5 consists. For example, if the support wire 7 is made of aluminum, the chemical agents selected will comprise caustic soda, which is a strong base which dissolves aluminum but does not attack precious metals such as gold and silver, which form the first precious metallic material of the external strip 4 of the ornamental wire 5.

According to the second and third embodiments, the first step of removing the elongated support 6 includes both dissolving the second metallic material of which the support wire 7 consists and dissolving the third metallic material of which the first elongated plate 8 consists without however damaging the metallic material of which the second elongated plate 9 consists and once again, obviously without damaging the first precious metallic material. For example, if the support wire 7 and the first elongated plate 8 both are made of aluminum, the chemical agents selected once again will comprise caustic soda, which is a strong base which dissolves aluminum but does not attack precious metals such as gold and silver, which form the first precious metallic material of the external strip 4 of the ornamental wire 5 and the second elongated plate 9.

Such a second elongated plate 9 therefore advantageously remains constrained to the solid cord 15, both to confer elasticity to the mechanical structure of the jewelry article and to keep the spirals of the ornamental wire(s) 5 in the winding position thereof.

In particular, if the second and third metallic materials are selected to be equal (e.g. aluminum as indicated above), such a first dissolution step occurs simultaneously by means of one bath of chemical agents alone. Otherwise, such a first dissolution step is carried out in two successive passages, in particular in a specific bath of chemical agents for dissolving each of the two different materials used.

Advantageously, according to the third embodiment, as mentioned above, there is further included a molding via pressing step during which the spirals of ornamental wires 5 are close to one another. Such a molding step is preferably performed after the first step of removing the elongated support 6.

In order not to damage the jewelry article 1 during the molding step, it is a good idea for the internal core 3 to still be present in such a step. At the same time, in order to allow a deformation of the spirals during the molding step itself, it is a good idea for the support wire 7 and the first elongated plate 8 to have already been removed.

To this end, the first metallic material of which the internal core 3 of each ornamental wire 5 consists is selected to be different from the second and third metallic materials of which the support wire 7 and the first elongated plate 8 consist, respectively, so that the internal core 3 is not dissolved during the first removal step and it remains inside the external strip 4 of each ornamental wire 5.

The molding via pressing step is preferably a cold step, and provides for the solid cord 15 to be arranged inside a mold made of rigid material having an inner shaped seat. Such a mold preferably consists of two shells which mirror each other, each having a shaped seat adapted to house half of the volume of the solid cord 15 to be subjected to the molding step.

Following the pressing of the mold, the spirals of the ornamental wires 5 are forced to move close to one another, coming into close contact with one another and substantially eliminating the gaps in particular present at the strips with large radius of curvature.

Advantageously, the spirals do not collapse and form unappealing creases or folds due to the presence of the first metallic material (e.g. soft iron) of which the internal core 3 consists, which allows an increased mechanical resistance to the mechanical stresses, in particular to the fatigue stresses such as uniform compression. Therefore, the spirals only plastically collapse enough to be mutually compacted, thus closing the gaps formed therebetween, in particular at the strips with large radius of curvature, and thus forming an elliptical-section solid cord 15 with compact spirals which are very adherent to one another and have a pleasant appearance.

The process then includes a second step of removing the internal core 3 from each ornamental wire 5 of the solid cord 15. Such a removal step is preferably obtained by means of dissolution in a second bath of chemical agents and/or reagents, such a bath being adapted to dissolve the internal core 3 consisting of the first metallic material.

The chemical reagent (e.g. caustic soda) penetrates the solid cord 15 during such a second removal step.

Indeed, slit 4" delimited by the longitudinal edges 4' of the external strip 4 of each ornamental wire 5 allows the reagent to seep into the same external strip 4 and to dissolve the first metallic material of which the internal core 3 consists, thereby forming a lightened cord 18.

According to the first and second embodiments, the first removal step and the second removal step may coincide, in particular if the first metallic material of which the internal core 3 of each ornamental wire 5 consists, the second and third metallic materials of which the support wire 7 consists and the first elongated plate 8, are the same, since only one bath comprising the same chemical reagent would be required to dissolve all the components simultaneously.

Preferably, according to the first and second embodiments, the first metallic material of which the internal core 3 of each ornamental wire 5 consists, the second and third metallic materials of which the support wire 7 consists and the first elongated plate 8 are all made of aluminum, which are simultaneously eliminated with a single coinciding removal step by means of a bath of caustic soda.

The duration of the baths in the chemical agent solutions depends on the sizes of the articles, in particular of the solid cord 15, i.e. on the ease of the internal core 3 to come out of the slits 4" of the external strip 4.

Figure 7:
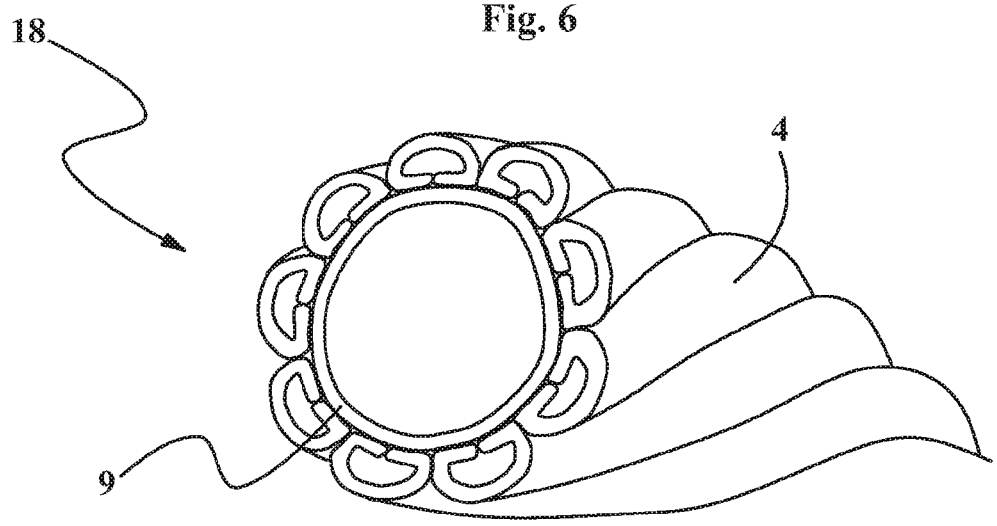
FIG. 7 shows a perspective view of a transverse section of a lightened cord with nine ornamental wires, obtained with the process according to the invention in a second embodiment thereof.

According to the first embodiment, such a lightened cord 18 comprises only the external strip 4 of each ornamental wire 5, while according to the second and third embodiments, the lightened cord 18 internally also comprises the winding of the second elongated plate 9, as shown in FIG. 7.

The lightened cord is then subjected to a cutting step in which it is divided into sections obtained with repeated cuts at transverse sections along the longitudinal extension axis Y thereof. Each section is intended to form a single ornamental article, e.g. a bracelet 1.

Figure 6:
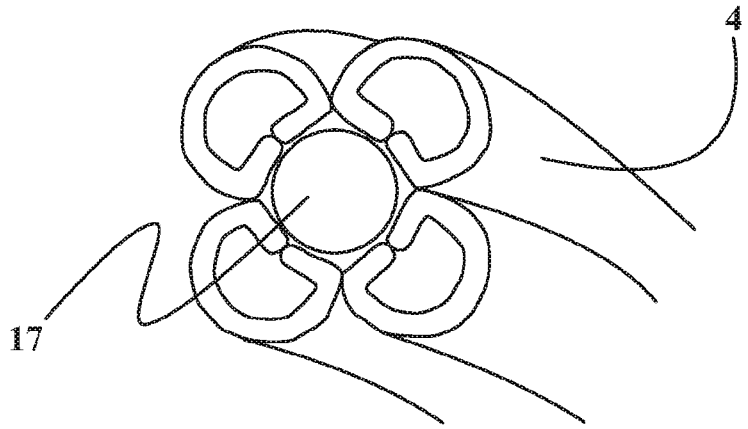
FIG. 6 is a perspective view of a transverse section of a lightened cord with four ornamental wires, obtained with the process according to the invention in a first embodiment thereof.

Advantageously, the process according to the invention includes a step of inserting an open ring-shaped spring 17 into the hole left free by the removal of the elongated support 6. Such a spring 17 is inserted into each section of the lightened cord 18 to increase the mechanical features of elasticity and stress resistance of the bracelet, or more generally of the jewelry article. FIG. 6 shows a transverse section of a cord consisting of four ornamental wires 5 and containing therein the annular spring 17.

Such a step of inserting spring 17 is easy to be carried out due to the shape of the ornamental wires 5, which have the aforesaid flat face 5' facing the inside of the solid cord 15.

In greater detail, the flat face 5' of each ornamental wire 5, together with the flat faces 5' of the other wound ornamental wires 5, defines a longitudinal hole which is coaxial to the lightened cord 18 and substantially has a convex polygonal section. The volume of the coaxial longitudinal hole thus defined is much greater than a hole which may be obtained inside a cord formed by winding circular section wires. Thereby, the longitudinal hole allows an easy insertion of the open annular-shaped spring 17, and may be manually inserted by an operator without any difficulty.

Spring 17 preferably consists of a flexible metallic material, such as e.g. steel and/or titanium.

There is then included a step of drawing the lightened cord 18 with the annular spring 17 inside to cause the spirals of the ornamental wire 5 to further adhere to one another and to the same spring 17, so as to create a resistant and elastic jewelry article in a single body.

The manufacturing process then includes a welding step, in which each section of lightened cord 18 is welded at the aforesaid transverse cutting sections to mechanically constrain the spirals to one another so they do not lose their form when used by the final user.

Advantageously, the process includes a step of firing the lightened cord 18 to reduce the tensions created in the lightened cord 18 during the operating steps included in the present manufacturing method. In particular, such a firing step occurs by inserting the lightened cord 18 into a furnace brought to a temperature from 200° C. to 700° C., according to the type of materials used and with an entirely conventional method not described in detail.

In particular, the firing also aims to reduce the tensions created in the elongated support 6, in the second elongated plate 9 and in the external strip 4 of each ornamental wire 5.

The firing step preferably occurs following the step of inserting the annular spring 17, the purpose being to cause the spirals of the lightened cord 18 to permanently adhere to spring 17.

In the third embodiment, such a firing step may also (or only) be carried out before the molding via pressing step, so as to soften the first precious metal of which the external strip 4 consists and to facilitate the plastic deformation thereof during such a molding via pressing step. For such a reason, the first metallic material of which the internal core 3 consists is e.g. soft iron, which has a higher melting point than the first precious metallic material of which the external strip 4 consists, and may sustain such a firing step without losing the mechanical features thereof.

The manufacturing process also includes a step of applying at least one cap or tip, and preferably two, at the transverse cutting sections. Thereby, the welds performed during the aforesaid welding step are hidden from the sight of the user, thus giving the jewel a pleasant appearance.

In particular, such caps may be made of any material, preferably of precious material, and may have any form and size and may have surface machining, grooves, patterns and/or text. The caps may also comprise precious stones.

The process for making a jewelry article of the present invention ends with a polishing step and/or a step of mirror-polishing, which are traditional per se, such as for example barrel polishing in vibrating barrels filled with small spheres of zirconium or steel adapted to surface grind the articles by removing the roughness and give them the shininess required.

Obviously, with the manufacturing process described hereto, it is possible to make jewelry articles which have a transverse section with respect to the main extension axis, which also has a different form than those indicated above, which are purely mentioned by way of example. Such jewelry articles may have for example a polygonal section, in particular square or hexagonal, without departing from the scope of the present invention, since they may be obtained by means of a manufacturing process which is entirely similar to that disclosed herein.

The present invention also relates to a jewelry article which is advantageously obtained by means of the process described hereto and of which the numerals already indicated will be used for simplicity.

The jewelry article, comprising a cord provided with at least one ornamental wire 5, with spiral-winding along an extension direction Y, as depicted in FIG. 1.

The ornamental wire 5 preferably consists of a first precious or semi-precious metallic material, such as e.g. gold, silver or platinum, or of a precious or semi-precious metallic material alloy.

According to the idea at the basis of the present invention, the cord is provided with an annular hole arranged coaxially to the spiral-winding of the ornamental wire 5. In particular, the ornamental wire 5 has an open-ring transverse section and has a flat face 5' facing the longitudinal axis Y.

The flat face 5' is formed by two adjacent flaps joined externally by a convex portion and ending with two parallel longitudinal edges 4' delimiting a slit 4" arranged at the same flat face 5'.

Advantageously, the jewelry article is lightweight and has a significant mechanical elasticity. In particular, the jewelry article has an increased resistance to mechanical stresses and is particularly suitable for being used daily, thus ensuring increased practicality of use.

In a second embodiment, the jewelry article comprises a spiral-wound elongated plate 9 arranged inside the spiral of the ornamental wire 5, which is coaxially and mechanically engaged with the latter to confer further elasticity to the cord and not to allow the spirals of the ornamental wires 5 to move and damage the appearance.

Such an elongated plate 9 preferably consists of a second precious or semi-precious material, such as e.g. gold, silver or platinum, or of a precious or semi-precious metallic material alloy.

Advantageously, the jewelry article of the present invention further comprises an annular spring 17 which is arranged inside the annular hole arranged coaxially to the spiral-winding of the ornamental wire 5 to further increase the elasticity of the article and confer noticeable resistance to mechanical stresses.

Advantageously, the jewelry article may comprise one or more side caps at its ends to further improve the appearance thereof.

Thereby, the jewelry article of the present invention has a pleasant appearance and is noticeably lightweight and has increased mechanical elasticity.

Therefore, the invention thus conceived achieves the preset objects.

Obviously, the jewelry articles according to the invention may also take, in the practical embodiment thereof, different forms and configurations from those disclosed above (cord-shaped bracelets) without departing from the present scope of protection. For example, they may also consist of rigid or semi-rigid cord or braided necklaces, i.e. rings in the shape of a cord or braid.

Furthermore, all details can be replaced by technically equivalent elements and any dimensions, shapes and materials can be used depending on needs.

The invention claimed is:

1. A process for making a jewelry article, the process comprising the following operating steps:

a step of arranging an elongated support, stretched between two ends along a longitudinal extension direction;

a step of making at least one ornamental wire by means of covering at least one internal core, made of a first metallic material, with at least one external strip made of a first precious or semi-precious metallic material;

a step of spiral-winding said at least one ornamental wire around said elongated support along said longitudinal extension direction, in order to obtain a solid cord;

a first step of removing said elongated support from said solid cord;

a second step of removing said at least one internal core from the at least one ornamental wire of said solid cord;

said first removal step and said second removal step transforming said solid cord into a lightened cord;

wherein said step of making said at least one ornamental wire is obtained by feeding a forming head with said at least one internal core and with said at least one external strip, which is provided with a flattened form with parallel longitudinal edges, said making step covering said at least one internal core with said at least one external strip until said longitudinal edges are side-by-side in opposite position and separated from each other by a slit on a flat face of said at least one ornamental wire;

said spiral-winding step being achieved by maintaining the flat face of said at least one ornamental wire directed towards said elongated support.

2. The process for making a jewelry article according to claim 1, wherein said spiral-winding of said at least one ornamental wire around said elongated support along said longitudinal extension direction is obtained by advancing a trolley along said longitudinal direction of said elongated support; said at least one ornamental wire feeding a corresponding through seat of a guide body mounted on said trolley, with sliding of the flat face of said at least one ornamental wire on an opposite guiding flat face of said guide body.

3. The process for making a jewelry article according to claim 2, wherein the spiral-winding of said at least one ornamental wire around said elongated support along said longitudinal extension direction is obtained by advancing said trolley along said longitudinal direction of said elongated support; at least two ornamental wires being provided which feed the through seats of two said corresponding guide bodies mounted on said trolley on opposite sides of said elongated support.

4. The process for making a jewelry article according to claim 3, wherein the through seats of said at least two guide bodies feed said elongated support by means of corresponding said at least two ornamental wires, tangentially with respect to said elongated support and in diametrically opposite positions.

5. The process for making a jewelry article according to claim 2, wherein said at least one through seat of said guide body feeds the winding of said elongated support by means of one corresponding said at least one ornamental wire, tangentially with respect to said elongated support.

6. The process for making a jewelry article according to claim 1, wherein said step of making said at least one ornamental wire provides for the use of the first metallic material for the at least one internal core with higher melting point with respect to the first precious or semi-precious material of said at least one external strip;

after said first step of removing said elongated support, a molding via pressing step being provided, in particular molding via cold pressing, in which the turns of said wound at least one ornamental wire are close to each other.

7. The process for making a jewelry article according to claim 6, wherein before or after said molding via pressing step, a firing step is provided in order to reduce the tensions created in the elongated support and in the at least one ornamental wire.

8. The process for making a jewelry article according to claim 7, wherein after said molding or firing step, said second removal step is provided by means of dissolution in a bath of chemical agents adapted to dissolve the at least one internal core of said at least one ornamental wire.

9. The process for making a jewelry article according to claim 1, said step of arranging an elongated support provides for winding a spiral of a first elongated plate made of a third metallic material outside a support wire made of the second metallic material; a further spiral-winding step being provided for winding a second elongated metallic plate around the spiral of said first elongated plate.

10. The process for making a jewelry article according to claim 9, wherein said step of arranging said elongated support provides for the spiral-winding of said first elongated plate around said support wire with flattened shaped form.

11. The process for making a jewelry article according to claim 1, wherein said step of making a said at least one ornamental wire is obtained via drawing by feeding said forming head of drawing machine type, which winds said at least one external strip on said at least one internal core, which has a flattened surface facing the flat face of said at least one ornamental wire.

12. The process for making a jewelry article according to claim 1, wherein said solid cord is subjected to a step of annular shaping by winding it around a tubular body before said first and second removal steps.

* * * * *